US006866046B2

(12) United States Patent
Gueret

(10) Patent No.: US 6,866,046 B2
(45) Date of Patent: Mar. 15, 2005

(54) APPLICATOR SYSTEM AND METHOD

(75) Inventor: Jean-Louis H. Gueret, Paris (FR)

(73) Assignee: L'Oréal, Paris (FR)

( * ) Notice: Subject to any disclaimer, the term of this patent is extended or adjusted under 35 U.S.C. 154(b) by 95 days.

(21) Appl. No.: 09/813,003

(22) Filed: Mar. 21, 2001

(65) Prior Publication Data

US 2002/0020424 A1 Feb. 21, 2002

Related U.S. Application Data

(63) Continuation-in-part of application No. PCT/FR00/01373, filed on May 19, 2000.

(30) Foreign Application Priority Data

Jul. 21, 1999 (FR) ..... 99 09452
Jul. 21, 1999 (FR) ..... 99 09454

(51) Int. Cl.[7] ..... A45D 40/26
(52) U.S. Cl. ..... 132/218
(58) Field of Search ..... 132/218, 317, 132/320, 313, 219, 112, 160; 401/126, 129, 128, 130, 122

(56) References Cited

U.S. PATENT DOCUMENTS

| | | | |
|---|---|---|---|
| 997 | A | 11/1838 | Sanford |
| 155,977 | A | 10/1874 | Rogers |
| 466,496 | A | 1/1892 | Heysinger |
| 791,690 | A | 6/1905 | Grell |
| 819,444 | A | 5/1906 | Monroe |

(List continued on next page.)

FOREIGN PATENT DOCUMENTS

| | | |
|---|---|---|
| DE | 25 59 273 | 7/1977 |
| DE | 85 22 986 | 11/1985 |
| EP | 0 038 524 | 10/1981 |
| EP | 0 204 466 | 12/1986 |
| EP | 0 474 934 | 3/1992 |

(List continued on next page.)

OTHER PUBLICATIONS

Co–pending application No. 09/621,903; Title: Applicator, Applicator System, and Method for Applying a Product to the Eyelashes Inventor(s): Jean–Louis H. Gueret U.S. filing date: Jul. 21, 2001.

Co–pending application No. 09/621,901; Title: Eyelash Product Applicator, Applicator System, and Method Inventor(s): Jean–Louis H. Gueret U.S. filing date: Jul. 21, 2001.

Co–pending application No. 09/621,680; Title: Product Applicator, Applicator System, and Application Method for the Eyelashes Inventor(s): Jean–Louis H. Gueret U.S. filing date: Jul. 21, 2001.

(List continued on next page.)

*Primary Examiner*—John J. Wilson
*Assistant Examiner*—Robyn Kieu Doan
(74) *Attorney, Agent, or Firm*—Finnegan, Henderson, Farabow, Garrett & Dunner, L.L.P.

(57) ABSTRACT

A system for applying a product to at least one of eyelashes and eyebrows may comprise an applicator comprising a stem and an application element at an end of the stem. The application element may be configured to apply a product to at least one of eyelashes and eyebrows. The application element may comprise a support and at least one row of teeth extending from the support. Each of the teeth may have a free end, a root portion adjacent to the support, and a lateral surface extending from the root portion to the free end. The lateral surface of at least some of the teeth may include at least one of a region having a relief and a region having an angular portion. The system may also comprise a receptacle configured to contain the product and a wiper member configured to wipe excess product from the application element when the applicator is removed from the receptacle. Also provided are methods of applying a product to eyelashes and eyebrows.

114 Claims, 4 Drawing Sheets

U.S. PATENT DOCUMENTS

| | | | | | |
|---|---|---|---|---|---|
| 1,094,013 | A | | 4/1914 | Peterson | |
| 1,130,574 | A | | 3/1915 | Corley | |
| 1,341,158 | A | * | 5/1920 | Synohubyk | 132/160 |
| 1,580,365 | A | | 4/1926 | Bechtold | |
| 1,670,161 | A | | 5/1928 | Meyer | |
| 1,780,206 | A | | 11/1930 | McKellar | |
| 1,829,228 | A | | 10/1931 | Lewis | |
| 1,892,749 | A | | 1/1933 | Philaja | |
| 1,963,389 | A | | 6/1934 | Vardeman | |
| 1,989,185 | A | | 1/1935 | Clein | |
| 2,175,344 | A | | 10/1939 | Friedman | |
| 2,255,618 | A | | 9/1941 | Huppert | |
| 2,264,346 | A | | 12/1941 | Tupper | |
| 2,348,339 | A | | 5/1944 | Golden | |
| 2,395,002 | A | | 2/1946 | Kemmer | |
| 2,569,246 | A | | 9/1951 | Marcellus | |
| 2,596,296 | A | | 5/1952 | Shields | |
| 2,626,618 | A | | 1/1953 | Collison | |
| 2,655,925 | A | | 10/1953 | Ulvad | |
| 2,806,476 | A | | 9/1957 | Thompson | |
| 3,312,583 | A | | 4/1967 | Rochlis | |
| 3,575,183 | A | * | 4/1971 | Tanner | 132/160 |
| 3,669,130 | A | | 6/1972 | Petroczky | |
| 3,763,870 | A | | 10/1973 | Montgomery et al. | |
| 3,862,639 | A | | 1/1975 | Schefer et al. | |
| 3,892,248 | A | | 7/1975 | Kingsford | |
| 3,921,650 | A | | 11/1975 | Montgomery | |
| 3,930,280 | A | | 1/1976 | Vasas | |
| 4,365,642 | A | | 12/1982 | Costa | 132/218 |
| 4,403,624 | A | | 9/1983 | Montgomery | |
| 4,422,986 | A | | 12/1983 | Cole | |
| 4,561,456 | A | | 12/1985 | Gueret | |
| 4,565,205 | A | | 1/1986 | Taylor | |
| 4,605,026 | A | * | 8/1986 | Nolin | 132/112 |
| 4,635,659 | A | | 1/1987 | Spatz | |
| 4,660,582 | A | | 4/1987 | Taylor | |
| 4,712,936 | A | | 12/1987 | Kessler | |
| 4,744,377 | A | | 5/1988 | Dolan, Jr. | |
| 4,804,004 | A | | 2/1989 | Taylor | |
| 4,964,429 | A | | 10/1990 | Cole | |
| 5,007,442 | A | | 4/1991 | Hirzel | |
| 5,046,213 | A | | 9/1991 | Curtis et al. | |
| 5,086,793 | A | | 2/1992 | Kingsford | |
| 5,094,254 | A | * | 3/1992 | Krueckel et al. | 132/218 |
| 5,137,387 | A | | 8/1992 | Byrd et al. | |
| 5,161,554 | A | | 11/1992 | Fitjer | |
| 5,370,141 | A | | 12/1994 | Gueret | |
| 5,462,798 | A | | 10/1995 | Gueret | |
| 5,694,953 | A | * | 12/1997 | Stephan et al. | 132/160 |
| 5,765,573 | A | | 6/1998 | Gueret | |
| 5,918,994 | A | | 7/1999 | Gueret | |
| 5,951,185 | A | | 9/1999 | Kingsford et al. | |
| 5,970,990 | A | * | 10/1999 | Dunton et al. | 132/218 |
| 6,053,179 | A | | 4/2000 | Lhuisset | |
| 6,343,607 | B1 | * | 2/2002 | Gueret | 132/218 |

FOREIGN PATENT DOCUMENTS

| | | |
|---|---|---|
| FR | 1 531 835 | 7/1968 |
| FR | 2 564 712 | 11/1985 |
| FR | 2 744 608 | 8/1997 |
| FR | 2 748 636 | 11/1997 |
| FR | 2 769 808 | 4/1999 |
| GB | 265027 | 2/1927 |
| GB | 2 146 520 | 4/1985 |
| GB | 2 159 699 | 12/1985 |
| GB | 2 256 586 | 12/1992 |
| JP | 7-322915 | 12/1995 |
| JP | 9-108033 | 4/1997 |
| JP | 10-215944 | 8/1998 |
| JP | 11-155629 | 6/1999 |
| WO | WO 95/17837 | 7/1995 |
| WO | WO 97/28719 | 8/1997 |

OTHER PUBLICATIONS

Co–pending application No. 09/624,004; Title: Product Applicator, Applicator System, and Method of Application for Eyelashes Inventor(s): Jean–Louis H. Gueret U.S. filing date: Jul. 21, 2001.

Co–pending application No. 09/813,004; Title: Angled Tooth Applicator, System, and Method of Product Application Inventor(s): Jean–Louis H. Gueret U.S. filing date: Mar. 21, 2001.

Co–pending application No. 09/813,002; Title: Applicator, System, and Method of Product Application Inventor(s): Jean–Louis H. Gueret U.S. filing date: Mar. 21, 2001.

English language Derwent Abstract of DE 25 59 273, Jul. 7, 1977.

English language Derwent Abstract of EP 0 038 524, Oct. 28, 1981.

English language Derwent Abstract of FR 2 744 608, Aug. 14, 1997.

English language Derwent Abstract of FR 2 748 636, Nov. 21, 1997.

English language Derwent Abstract of FR 2 769 808, Apr. 23, 1999.

English language abstract of JP 7–322915, Dec. 12, 1995.

English language abstract of JP 9–108033, Apr. 28, 1997.

English language abstract of JP JP 10–215944, Aug. 18, 1998.

* cited by examiner

APPLICATOR SYSTEM AND METHOD

This application is a continuation-in-part (CIP) of copending PCT international application No. PCT/FR00/01373, filed May 19, 2000, which claims the benefit of priority to French Application Nos. 99/09454 and 99/09452, both filed on Jul. 21, 1999.

The present invention pertains to applicators, and methods of using such applicators, for applying a product. In particular, the present invention is directed to an applicator for the application of a product, such as a cosmetic product, for example, to the eyelashes or eyebrows. The invention also relates to an applicator system including the applicator and a receptacle for containing the product to be applied.

French Patent Application Nos. 2,769,808 and 2,564,712 disclose applicators having applicating members that include spaces between the members, which can be filled with product as the applicator is being extracted from a container.

U.S. Pat. No. 4,561,456 discloses an applicator having bristles that have smooth side surfaces and free ends that form hooks.

In order to provide an ample supply of product on the applicator, the teeth of some applicators are relatively widely spaced apart. For example, the spacing between adjacent teeth of some conventional applicators is larger than the diameter of an eyelash. Such a configuration, however, suffers from the drawback of the eyelashes being taken hold of only weakly by the applicator. Moreover, the product deposited on the surfaces of the eyelashes for the purpose of lengthening them may not be spread entirely satisfactorily.

In light of the foregoing, there is a need in the art for an improved system and method of applying a product to eyelashes and eyebrows.

An aspect of the present invention may include providing a novel device for packaging a product and for applying the product to eyelashes or other types of hair. The device may be capable of taking hold of the eyelashes satisfactorily while also enabling relatively large supplies of product to be held between teeth of the device.

An aspect of the invention may include a system for applying a product to at least one of eyelashes and eyebrows. The system may comprising an applicator comprising a stem (e.g., a wand) and an application element at an end of the stem. For example, the applicator element may be on an end of the stem. The applicator element may be provided with at least one row of a succession of consecutive teeth. An axis of the row may be substantially straight or curved. The teeth may be formed by molding plastic. The application element may be configured to apply a product to at least one or eyelashes and eyebrows. The application element may comprise a support and at least one row of teeth extending from the support. Each of the teeth may have a free end, a root portion adjacent to the support, and a lateral surface extending from the root portion to the free end. The lateral surface of at least some of the teeth may include at least one of a region having a relief and a region having an angular portion. The system may also include a receptacle configured to contain the product. Optionally, the system may further include a wiper member. The wiper member, for example, may be on the receptacle. The wiper member may be configured to wipe excess product from the application element when the applicator is removed from the receptacle.

In an aspect, the application element and the stem may be a single piece construction produced by molding plastic.

In another aspect, the lateral surface of each of at least some of the teeth may be provided with regions of relief formed integrally with the teeth and/or with an angular portion.

The term "region of relief" or "region having relief" as used herein means a region including one or more projections, recesses, grooves, depressions, and/or uneven portions that are visible to the naked eye.

The term "angular portion" as used herein means a region including both a portion forming a salient angle and a portion forming a re-entrant angle, with a sharp edge or a rounded edge of small radius of curvature producing the desired result in either case.

In yet another aspect, the lateral surface of at least some of the teeth may not be substantially rectilinear when the application element is viewed from a side thereof.

In a further aspect, the lateral surface of at least some of the teeth may include the region having the angular portion. For example, the angular portion may be zigzag shaped.

In yet another aspect, the lateral surface of at least some of the teeth may include the region having the relief. For example, the relief may comprise at least one projection. The projection may extend in a direction away from the support, in a direction toward the support, and/or in a direction substantially parallel to the support. Alternately, the relief may comprise at least one of fluting and annular grooves. In another embodiment, the relief may comprise serrations.

In still another aspect, the at least one row of teeth may comprise teeth having base portions disposed, at least partially, on opposite sides of a geometric separation plane. This configuration may make it possible to reduce the spacing between the teeth while also forming supplies of product that are sufficient between them. Alternately, the base portions may be substantially aligned.

In one embodiment, the application element and the at least one row of teeth may be of unitary construction. For example, the application element and the at least one row of teeth may be constructed by one of molding and stamping. The applicator element may be produced by molding plastic as a single piece with the applicator stem and with a sealing member configured to seal the container closed when it is not in use. The sealing member may have a surface shaped to fit in a sealed manner into the neck of the receptacle. A cap may be disposed at an end of the applicator opposite to an end on which the teeth are disposed, the cap being configured to close the container. The cap also can be provided with the sealing member to sealably close the container.

The application element may optionally include an elastomer material. In an embodiment, the application element may include a plastic material more flexible than a material of the stem. Greater comfort may be obtained when using such an applicator.

As an alternative, the stem may be more flexible than the application element. For example, the stem may be made of a plastic that is more flexible than the material used to make the application element. It is possible, for manufacturing reasons, to use a relatively inflexible material to make the application element and to compensate for the inflexibility of the application element at the time of application, using the flexibility of the stem.

In another embodiment, the application element may be an element separate from the stem. For example, the application element may be mounted on the stem.

In another aspect, the application element may have just one row of teeth (or more than one row of teeth), essentially forming a comb. Alternatively, the applicator may have more than one row of teeth disposed around the applicator, essentially forming a brush. For example, the applicator may include one row of teeth disposed on a substantially opposite side of the applicator as another row of teeth.

In still another aspect, the at least one row of teeth may comprise teeth having base portions. Each of the base portions may have a cross-section having an axis forming an angle with an axis of the support. The axes of the cross-sections and the axis of the support may form a plurality of angles. Alternately, the axes of the cross-sections and the axis of the support may all form substantially the same angle.

In a further aspect, the at least one row of teeth may comprise teeth having different shapes.

In an aspect, the stem may be on a handle member.

In another aspect, the receptacle may include an opening configured to permit passage of at least a part of the application element into the receptacle, and the handle member may comprise a cap configured to sealably close the opening. The receptacle may contain a product, for example, it may contain a product configured to be applied to eyelashes and/or eyebrows, such as mascara.

In still another aspect, the support may include an outwardly-convex face. The at least one row of teeth may be on the outwardly-convex face. An axis of the stem and a line tangent to a point on the outwardly-convex face in a direction at least partially along a longitudinal axis of the outwardly-convex face may form an angle that increasing as a distance between the point and the end of the stem increases.

The teeth may be made of either the same material as the support or a different material. The height of the teeth may vary. The height of the teeth may range from about 0.5 mm to about 15 mm. Alternatively, the height of the teeth may range from about 0.5 mm to about 10 mm or from about 7 mm to about 13 mm.

In an embodiment, the at least one row of teeth may comprise teeth having a height ranging from about 0.5 mm to about 10 mm. The lateral surface of at least some of the teeth may be flocked. The teeth may be made of a elastic material including a gliding agent for improving gliding of eyelashes and eyebrows on the teeth. For example, the gliding agent may be chosen from polytetrafluoroethylene, graphite, silicones, molybdenum disulfide, and derivatives thereof.

In a further aspect, the application element may further comprise an eye-liner tip.

In another aspect, the application element may further comprise at least one tuft of bristles located adjacent to a pair of consecutive teeth of the at least one row of teeth. In an embodiment, the at least one tuft of bristles may be located between the pair of consecutive teeth.

In an additional aspect, the lateral surface of at least some of the teeth may have at least one irregular-shaped region configured to hold the product and to engage the eyelashes, thereby enabling application of the product from the region to the eyelashes when the application member is moved along the eyelashes.

As used herein, the term "irregular-shaped region" means a region that is not smooth or straight, and that includes features capable of holding product, such as, for example, one or more protrusions, recesses, depressions, grooves, troughs, uneven portions and angular portions.

The system may optionally include a receptacle containing a product configured to be applied to eyelashes. The system may also optionally include a wiper member configured to wipe excess product from the application element when the applicator is removed from the receptacle. The wiper may be deformable, and may include a block of open-cell foam or an elastomeric lip, or other similar suitable configurations. In an embodiment, the wiper member may be on the receptacle.

There are many different types of receptacles that could be used with the applicator system. For example, the product could be stored in a tube-like container. This tube may be made of a flexible material that when squeezed can dispense product onto the application element of the applicator device. Other dispensers also can be used to dispense the product onto the application element, such as a pump-type dispenser, for example. Such alternate dispensers are considered within the scope of the invention.

Alternatively, the container could be configured to hold a solid cake of the product. This solid cake could be moistened in order to enable the applicator device to be loaded with product by placing the application element in contact with the moistened part of the product. Alternatively, the application element could be moistened and then placed in contact with the product to transfer moisture to the product.

When the product is contained in either a dispenser or a cake arrangement, the proximal end of the applicator device may lack a handle or a cap, since the applicator device can be configured such that it is not stored in the container containing the product or does not close off such a container. In such an arrangement, the stem itself can be used as a handle.

In an embodiment, the irregular-shaped region may include a plurality of troughs. The troughs may be configured to hold the product and/or to engage the eyelashes, thereby enabling application of the product from the troughs over a surface of the eyelashes when the application element is moved along the eyelashes.

In another embodiment, the irregular-shaped region may be zigzag shaped. For example, the irregular-shaped region may comprise angular portions including a salient angle and a reentrant angle forming a zigzag shape.

In a further embodiment, the irregular-shaped region may include a plurality of protrusions configured to engage the eyelashes, thereby enabling smooth application of the product over a surface of the eyelashes when the application element is moved along the eyelashes. The protrusions may form a plurality of recesses configured to hold the product. The protrusions may extend in a direction towards the support, for example, the protrusions may form a barbed or Christmas-tree configuration. Alternately, the protrusions may extend in a direction away from the support or a direction substantially parallel to the support.

In still another embodiment, the irregular-shaped region may include a plurality of grooves. The grooves may be configured to hold the product and/or to engage the eyelashes, thereby enabling application of the product from the grooves over a surface of the eyelashes when the application element is moved along the eyelashes. For example, the grooves may be serrations.

Another aspect of the invention includes a method of applying a product to the eyelashes or eyebrows using an applicator or system as described in the preceding paragraphs. The method may include loading a product on at least some of the teeth and placing at least some of the teeth in contact with the eyelashes such that the product coats the eyelashes. The loading may include inserting the applicator or a portion thereof into a receptacle containing the product, removing the applicator from the container, and wiping excess product from the teeth. For example, the method may include wiping excess product from the teeth with a wiper member. The loading alternatively may include either dispensing the product from the container onto the teeth or contacting the teeth with a solid cake of product. The solid cake of product may be moistened and the teeth may be placed in contact with the moistened cake of product. In the latter form of loading, the moistening of the product may include either moistening the teeth and then contacting the teeth with the product or moistening the product with a pre-moistened applicator.

The method may optionally comprise gripping the eyelashes between adjacent teeth.

In one example of a method according to the invention, the product being applied is mascara. If the mascara includes fibers, the method may further include orienting the fibers with the teeth such that the fibers are substantially parallel to the eyelashes as the product is applied.

In another aspect, the method may include connecting a portion of the application element of the applicator to the stem of the applicator. For example, the method may include selecting an application element from a plurality of application elements and connecting the selected application element to the stem.

In another aspect, the method may include providing an applicator including an eyeliner tip and applying eye liner to skin adjacent to eyelashes with the eye-liner tip.

The applicator of the invention, as described above, may be used for applying a cosmetic product, such as mascara, to the eyelashes. However, the applicator could be used to apply other products to other surfaces. In addition, the applicator according to the present invention could also be used to comb the eyelashes or eyebrows, for example.

By means of the invention (e.g., the regions in relief and/or angular portions), it may be possible to spread product over the surfaces of hairs of eyelashes and/or eyebrows in a satisfactory manner, while also retaining a large amount of freedom in the way the teeth are disposed on the support.

In accordance with the invention, the performance of the applicator may be significantly improved, while optionally retaining a conventional configuration for the way in which the teeth are disposed on the support.

The invention may make it possible to obtain an applicator that has endurance between refills that is acceptable and suitable for achieving makeup results that are of good quality.

By means of better hold on eyelashes that may be obtained in the invention, it may be easier to curve them when desired.

In an embodiment, the application element may be fixed to the stem, and an axis of the application element may be either parallel or at an angle to the axis of the stem. An end of the application element may be secured to a handle member that also constitutes a cap for closing the receptacle.

The application element may also be made integrally with the above-mentioned stem.

The stem of the applicator may be made integrally with sealing means so as to close the receptacle in a leaktight manner.

The lateral surface of each of at least some of the teeth may be zigzag in shape, the angular portions then being formed by alternating changes of direction of the teeth.

The smoothing effectiveness of the applicator may be further improved by particular teeth configurations.

In an embodiment of the invention, the application element may be configured as a comb.

The outer surface of the application element may be cylindrical, with its directrix being in the general shape of a drop of water, for example.

The application element may be provided with a plurality of rows of teeth having multiple angular positions about the axis of the support, and may be configured as a brush.

Optionally, the application element may be made integral (i.e., of unitary construction) with the teeth by molding.

The application element may be made of an elastomer material. In an embodiment, the application element is made of a plastic material more flexible than the material used to make the stem of the applicator. This configuration may make it possible to obtain curved, ergonomic applicators that are capable of deforming when passing through the wiper member.

The teeth may include a filled plastic material containing a filler of a material making it possible to improve the sliding properties of the hairs in contact with the teeth, in particular a filler of a material chosen from the following: polytetrafluoroethylene, graphite, silicones, molybdenum disulfide, and derivatives thereof.

In accordance with the invention, it may be possible to make use of the regions of relief and/or the angular portions on the teeth to improve the spreading of the product on the eyelashes and/or eyebrows, without any fear that the eyelashes or eyebrows will be held by the teeth in a manner uncomfortable for the user.

Aside from the structural and procedural arrangements set forth above, the invention could include a number of other arrangements, such as those explained hereinafter. It is to be understood that both the foregoing description and the following description are exemplary.

The accompanying drawings are included to provide a further understanding of some aspects of the invention and are incorporated in and constitute a part of this specification. The drawings illustrate embodiments of the invention and, together with the description, serve to explain some of the principles of the invention. In the drawings, FIG. 1 is a view of an embodiment of a system according the invention in an open position;

Reference will now be made in detail to some embodiments of the invention, examples of which are illustrated in the accompanying drawings. Wherever possible, the same reference numbers are used in the drawings and the description to refer to the same or like parts.

Figure 1:
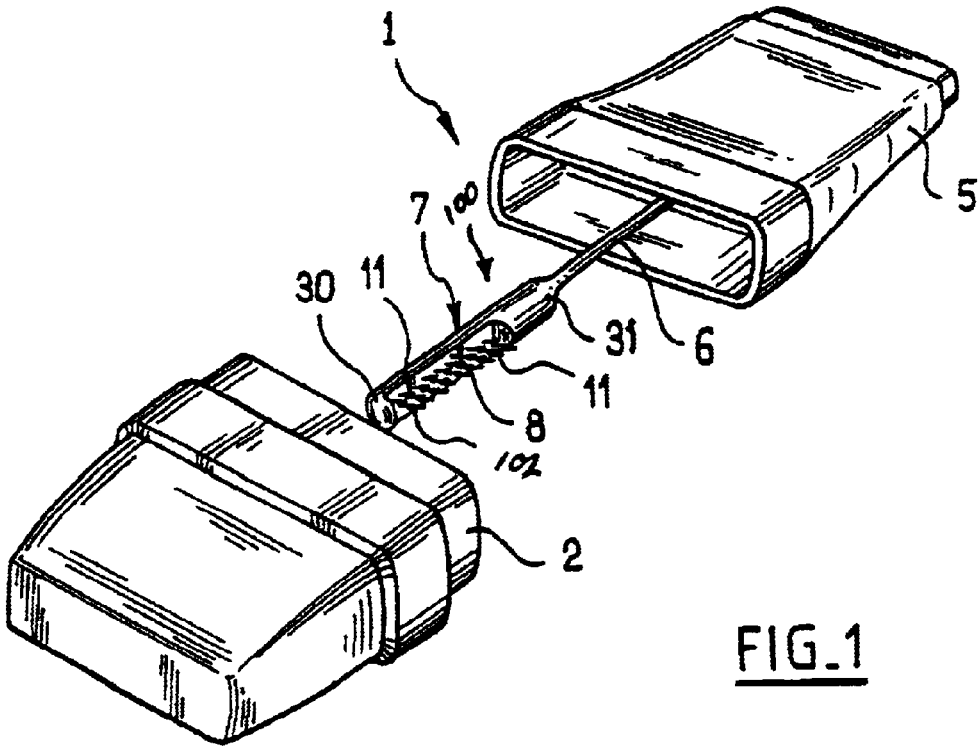
Figure 2:
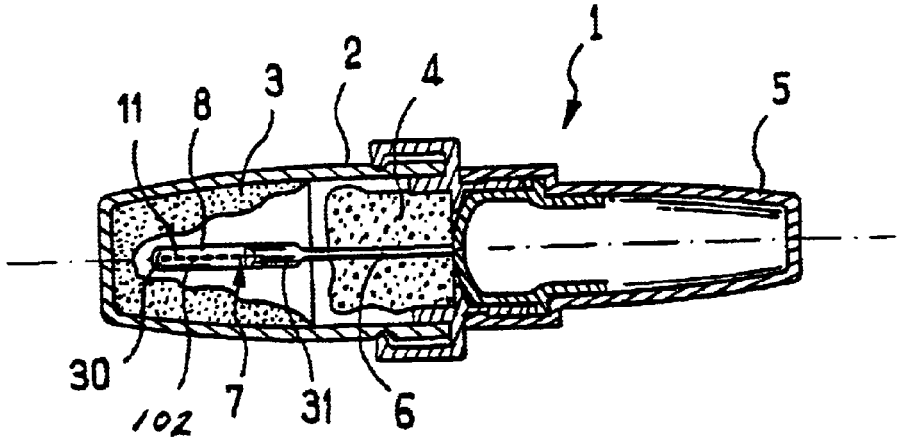
FIG. 2 is cross-sectional view of the system of FIG. 1 in a closed position.

An applicator system 1 according to an aspect of the present invention is shown in FIGS. 1 and 2. The applicator system 1 may include a receptacle 2 containing a product, for example, a cosmetic product such as mascara, and an applicator 100. Applicator 100 may include a stem 6 having a longitudinal axis. An application element 7 may be disposed on an end of the stem 6 and a handle or grasping element 5 may be disposed at an opposite end. The handle or grasping element 5 optionally may be in the form of a cap for closing the receptacle 2.

Figure 18:
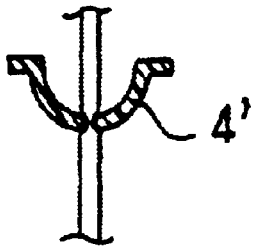
FIG. 18 is a view of a wiper member.

The receptacle 2 may include a wringing-out member or wiper 4. Wiper 4 may be made of a block of open-cell foam, as shown in FIG. 2, an elastomeric material, or other similar suitable material. Other types of wringing-out members or wipers may be used, such as a flexible lip which may or may not be flocked. For example, an optionally flocked flexible lip 4' is shown in FIG. 18. The wiper may be configured such that it flexes or deforms to the shape of the application element as it passes through the wiper.

When the receptacle is not in use, it may be sealed closed, for example, by providing a sealing member on the handle or grasping member 5 or, alternatively, on the applicator stem 6. The receptacle 2 may be closed in leaktight manner when not in use.

The application element 7 may be configured essentially in the form of a comb that includes a single row of teeth 11 disposed on a support 8 having a longitudinal axis. Teeth 11 may be molded, for example, as a single piece with the support 8 using plastic. In the embodiment shown in FIGS. 1 and 2, the application element 7 extends from a distal end of the applicator stem 6 and substantially in the same direction as the longitudinal axis of the applicator stem 6.

Over at least a part of its length, the wand or stem 6 may have a smaller diameter or width than the application element 7, so as to avoid permanently deforming the wiper 4 (or 4'). In the embodiment including the flexible lip 4' (FIG. 18), the stem 6 may be provided with a necked-down region facing an end of the lip 4' when the applicator is in place in the receptacle, so as not to deform the lip permanently.

As shown in FIGS. 1 and 2, the application element 7 may have a front portion 30 and a rear portion 31 that are shaped so as to make it easier for the application element 7 to pass through the wiper member 4 on being inserted into the receptacle 2 and on being removed therefrom.

The row of teeth 11 may extend between the front portion 30 and the rear portion 31 of the application member 7. The teeth may be coupled to the support 8. The support 8 may couple the front portion 30 and the rear portion 31.

In the example described, the teeth 11 may be made of a thermoplastic material. For example, the teeth 11 may be injection molded integrally with the remainder of the application member 7.

The teeth 11 may have various configurations without going beyond the ambit of the present invention.

The overall height of the teeth may range from about 0.5 mm to about 15 mm, or from about 7 mm to about 13 mm. The overall height of the teeth need not be uniform, but may vary from each other. Although numerous configurations for the teeth are contemplated by the invention, in each of the embodiments described, the length of a row of consecutive teeth may range from about 10 mm to about 45 mm, or from about 15 mm to about 28 mm, or from about 20 mm to about 26 mm. The individual lengths of each tooth may range from about 0.5 mm to about 15 mm, or from about 7 mm to about 13 mm. The number of teeth in a row of consecutive teeth may range from about 6 to about 50, or from about 10 to about 35, or from about 15 to about 32.

As mentioned above, the invention is not limited to an application element having one row of teeth, but also includes application elements including a number of rows of teeth, essentially forming a comb or brush, for example.

As shown in FIGS. 3–8, the teeth 11 may have a root portion 104 adjacent to the support 8, a free end 106, and a lateral surface 102 extending from the root portion 104 to the free end 106.

Figure 3:
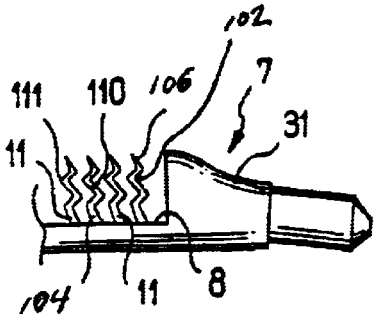
FIGS. 3 to 11 are partial-schematic views of embodiments of application elements.

Referring to FIG. 3, at least at a non-zero distance (e.g. one-third of the height of the tooth) from the free end 106 of the teeth 11, the lateral surface 102 of at least some of the teeth 11 may have irregular-shaped regions including angular portions tending to take hold of eyelashes and/or to improve the application and smoothing of the product on the surfaces of the eyelashes. For example, the teeth 11 may be of a generally zigzag shape. The changes in direction of each of the teeth 11 may form troughs 110 and projections 111 configured to retain some product and take part in separating the eyelashes. The troughs 110 and projections 111 may also enable smoothing of the product over the surface of eyelashes. In an embodiment, the lateral surface 102 of at least some of the teeth 11 may be provided with from about two changes of direction to about six changes of direction. For example, the embodiment shown in FIG. 3 includes four changes of direction.

In an embodiment, each of the teeth 11 may have a lateral surface 102 that is not rectilinear when the application element is observed from the side, as shown in FIG. 3.

Figure 4:
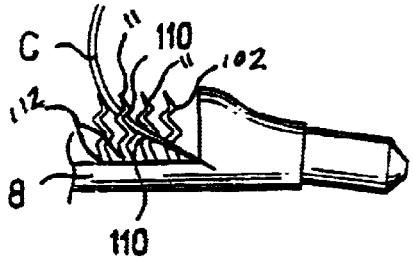

As shown in FIG. 4, an eyelash C may be engaged in the trough 110 of two adjacent teeth 11 and, optionally, held for the purpose of curving the eyelash C.

In another embodiment, the teeth 11 may have bases 112 that are aligned and uniformly spaced apart.

In still another embodiment the teeth 11 may have a cross-section substantially rectangular in shape. The teeth may be configured on the support 8 so that long sides of the rectangular cross-section are parallel to the longitudinal direction of the application element 7, thereby imparting some flexibility to the teeth 11 in the transverse direction, while the product is being applied to the eyelashes.

Other tooth shapes are described below with reference to FIGS. 5 to 9.

Figure 5:
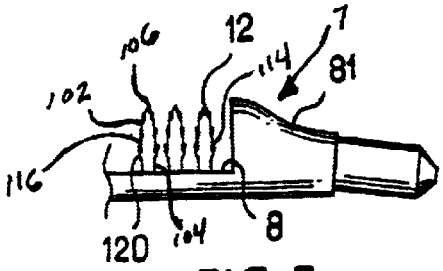

In FIG. 5, the teeth 11 may be replaced with teeth 12, each of which is generally pine cone shaped when the application element 7 is observed from the side thereof. The lateral surface 102 of at least some of the teeth 12 may be provided with an irregular-shaped region including projections 120 extending in a direction away from the support 8 (i.e., towards the free end 106), and co-operating with a body 116 of the teeth 12 to form recesses 114 suitable for holding product. The projections 120 and recesses 114 of the teeth 12 may form regions of relief enabling the product to be substantially smoothed over the eyelashes in a more effective manner.

Figure 6:
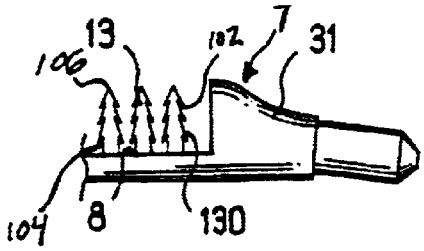

In an embodiment shown in FIG. 6, the teeth 11 may be replaced with teeth 13, each of which may be generally Christmas-tree (i.e., barbed) shaped when the application element 7 is observed from the side. In this embodiment, the lateral surface 102 may be provided with an irregular-shaped region including projections 130 that extend in a direction towards the support 8.

Figure 7:
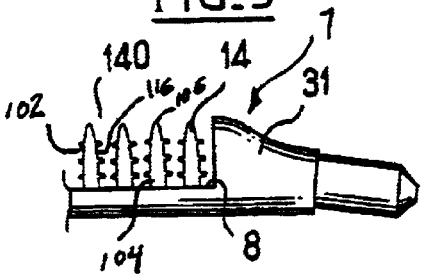

FIG. 7 shows an application element 7 having teeth 14. The lateral surface 102 of at least some of the teeth 14 may be provided with an irregular-shaped region including projections 140 that extend in a direction substantially perpendicular to the body 116 and/or that extend in a direction substantially parallel to the support 8 (i.e., towards and away from other teeth 14). When an eyelash is engaged between two consecutive teeth 14, the projections 140 may take part in holding the eyelash between the teeth 14, so that the product can be smoothed over the surface of the eyelash in a more effective manner.

The application element may be made by the injection-molding of plastic, but as an alternative, use may be made of methods for shaping material by compression, stamping or turning.

The support may include grooves or reliefs configured to hold the product.

The application element may include a part allowing it to be removably connected to the stem. As an alternative, the application element may be produced by molding plastic as a single piece with the applicator stem. In an embodiment, the application element has two substantially opposite ends and a portion located between the ends. One of the substantially opposite ends of the application element can be connected to a distal end portion of the stem, and a longitudinal axis of the application element may extend either at an angle to or substantially parallel to a longitudinal axis of the stem. Alternatively, the portion of the application element located between the two substantially opposite ends may be connected to a distal end portion of the stem, and the longitudinal axis of the application element may be substantially perpendicular to the longitudinal axis of the stem. The stem may be substantially flat.

The stem may include a connector at a distal end portion thereof, and the application element may be engageable with the connector. For example, the connector could define a slot configured to receive the application element.

Figure 8:
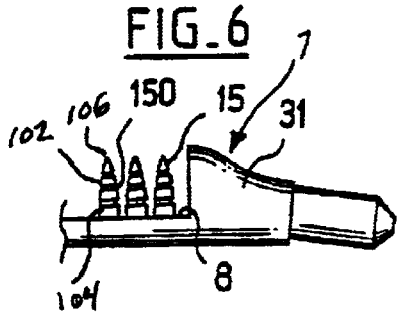

In the embodiment of FIG. 8, the teeth 11 may be replaced with teeth 15 having lateral surfaces 102 provided with an irregular-shaped region including annular grooves 150. The annular grooves 150 may hold product, and they may also be configured to define notches to engage and/or contact eyelashes when the product is being applied. The configuration of the application element 7 provided by the grooves 15 may tend to improve the extent to which the application element 7 takes hold of the eyelashes.

In the embodiments of FIGS. 5–8, a gap (i.e., distance) between two adjacent teeth can vary from the root portion 104 to the free end 106 of the teeth. For example, a distance between the teeth may alternately increase and decrease between the root portion 104 and the free end 106 of the teeth.

In another embodiment, the application element 7 may include more than one type of teeth. For example, FIG. 9 shows an exemplary application element 7 provided with a succession of multiple types of teeth.

Figure 10:
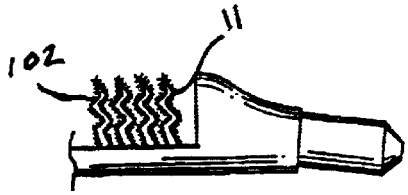

As shown in FIG. 10, the teeth 11 may be flocked to provide a texture or pattern on the lateral surface 102.

The support 8 may be provided with regions of relief or uneven portions, which may make it possible to hold supplies of product or to obtain a particular makeup effect.

Figure 9:
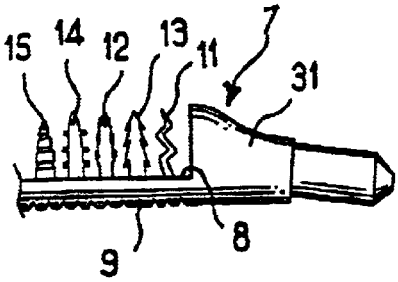

The embodiment of FIG. 9 shows the application element 7 with, on the side opposite from the teeth 11–15, a crenelated edge 9 that can serve to comb the eyelashes.

The application element 7 may also be provided with a plurality of rows of teeth distributed angularly about the longitudinal axis of the support in the configuration of a brush.

Figure 11:
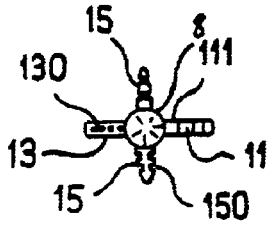

The rows of teeth may include projecting elements that may be identical or different. For example, FIG. 11 shows a front end view of an application element having an elongate support 8 having a circular cross-section. The support 8 may be provided with rows of teeth differing from row to row. The rows of different teeth may be on the support 8 in a direction substantially parallel to the axis of the support 8.

Figure 12:
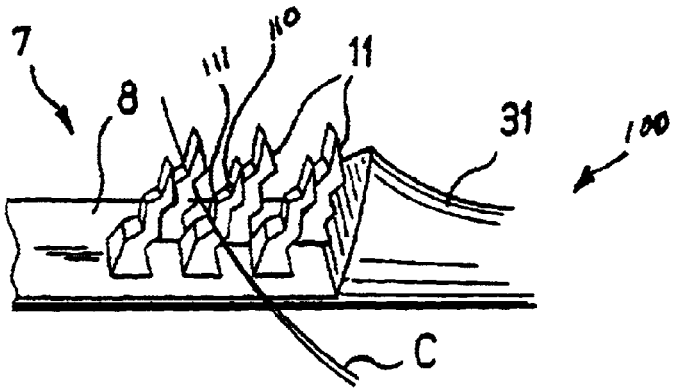
FIG. 12 is a view illustrating a method of applying a product to eyelashes.

Within each row, the teeth may be disposed in particular configurations for the purpose of further improving the effectiveness of the application element. For example, as shown in FIG. 12, the teeth 11 may be disposed in a staggered configuration on the support. In particular, FIG. 12 shows a row of teeth 11 offset having base portions 112 disposed, at least partially, on opposite sides of a geometric separation surface (e.g., a midplane of symmetry of the support 8). FIG. 12 also shows that regions of relief or irregularity provided on the teeth 11 (e.g., projections 111 and troughs 110) participate in taking hold of the eyelashes C that are engaged between them during use of the applicator 100.

The application element may include a succession of teeth including a first and a second series of teeth, wherein the teeth of the first series have a different shape than the teeth of the second series. Rows having first and second series of teeth may alternate. One of the series of teeth may itself be made up of teeth with differing shapes or even differing heights.

The teeth may have a height varying according to the axial position along the application element, for example a height which increases, decreases, decreases then increases, or increases then decreases from one end of the application element to the other.

The teeth may have a surface condition that increases the amount of product with which the application element becomes laden. For instance, the teeth and/or the support may include capillary grooves or flocking, over all or parts of their surface.

The teeth may undergo a surface treatment by abrasion so as to form forks at the ends of the teeth, for example.

The teeth may undergo a heat treatment, for example, to round their tips or form a bubble at their free end. The teeth thus become less aggressive toward the eyelashes.

The teeth and/or the support may be also coated with a gliding agent, such as a lacquer or Teflon, for example, to make them glide better along the eyelashes or, alternatively, to give them greater roughness. Such gliding agents may alternatively, or in addition be added to the material used to form the teeth.

The application element, and especially the teeth, may also include active ingredients, such as preservatives, moisturizers, copper salts, magnetic particles, and other similar suitable materials, to be released into the product when the product is loaded onto the application element. These active ingredients can either be included in the material used to form the application element, or can be coated onto the application element, or both. In addition, products that modify the surface tension of the application element upon contact with moisture can be used to form the teeth or to coat the teeth.

Figure 13:
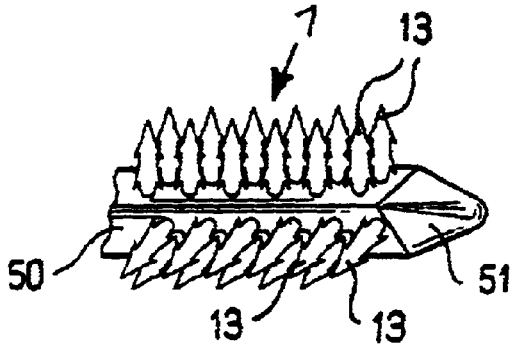
FIG. 13 is a partial-schematic view of an alternate embodiment of an application element.

As shown in FIG. 11, the support 8 may be of circular cross-section. Alternately, the cross-section of the support may be elliptical, polygonal, or otherwise. For example, FIG. 13 shows a support 50 of polygonal cross-section, each face being provided with a respective row of teeth 13. The support 50 may have a front portion 51 of tapering shape, which may facilitate insertion of the application element 7 through a wiper member. Although the teeth 13 in each row are shown alternately staggered, one of ordinary skill in the art would appreciate that the teeth 13 could also be aligned.

Figure 14:
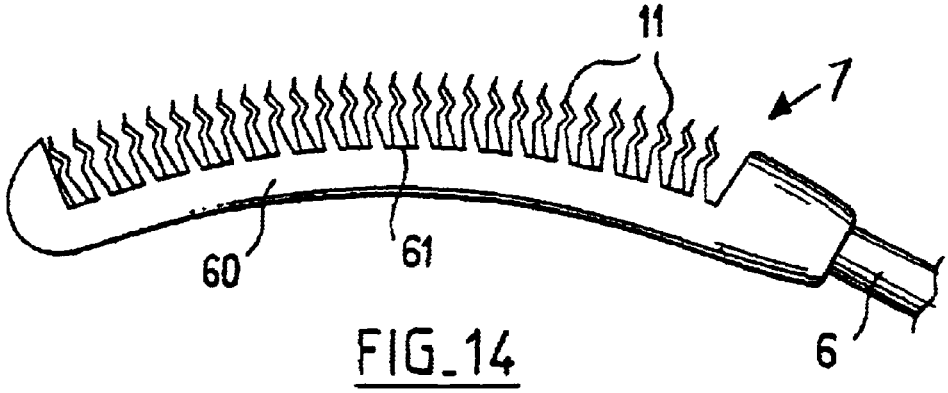
FIG. 14 is a view of an application element including an outwardly-convex face.

In an embodiment, the support may be curved to make the applicator more ergonomic, for example. FIG. 14 shows an application element 7 including a support 60 that is elongate in overall shape, and that has an outwardly-convex face 61. The face 61 forms an angle with the axis of the stem 6 that increases going away from the stem. In other words, an axis of the stem 6 and a line tangent to a point on the outwardly-convex face 61 in a direction at least partially along a longitudinal axis of the outwardly-convex face 61 form an angle that increases as a distance between the point and the end of the stem 6 increase.

The application element may be substantially flexible, allowing it to bend as the product is being applied. When the surface of the support on which the teeth are disposed is convex, the convex configuration may cause adjacent teeth to diverge away from each other, thus allowing a relatively large amount of product to be contained between adjacent teeth and consecutive teeth. Moreover, such an arrangement may achieve improved loading of the teeth with product as the application element is withdrawn through a wiper. This is because the force of the wiper on the application element may tend to straighten the axis of the application element and cause the teeth to move toward each other, particularly toward a middle portion (along the length) of the application element. As the teeth move toward each other, product may be forced between the teeth toward the root portion, again allowing the application element to hold a relatively large amount of product.

In an embodiment, when the application element is curved, it may be made of an elastomer material, a thermoplastics material, or of a vulcanized material, so that it can be deformed while passing through the wiper member.

In a variant (not shown), the application element may be curved about an axis perpendicular to the surface on which the teeth are connected.

Figure 15:
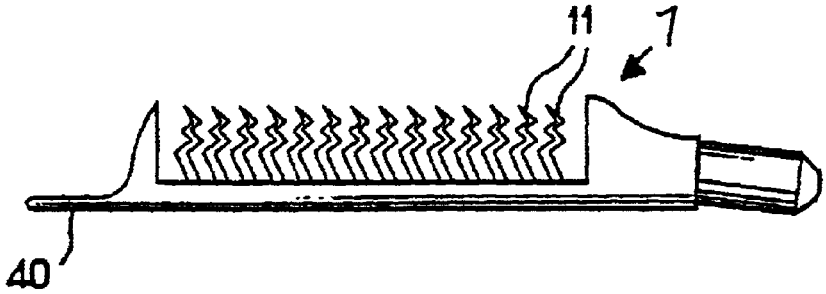
FIG. 15 is a view of an application element including an eye-liner tip.

As shown in FIG. 15, the application element 7 may include an eye-liner tip 40 at, for example, a front end, of the application element 7. The eye-liner tip 40 may be used to apply eyeliner to skin adjacent to eyelashes, for example.

Figure 16:
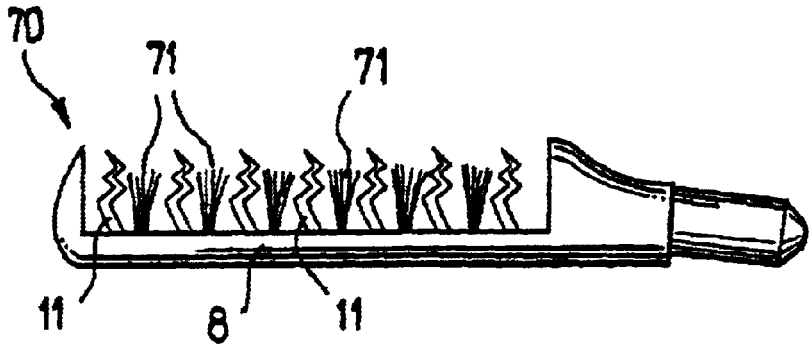
FIG. 16 is a view of an application element including tufts of bristles between the teeth.

FIG. 16 shows an application element 70 provided with tufts of bristles 71 extending from the support 8 between the teeth 11.

Figure 17:
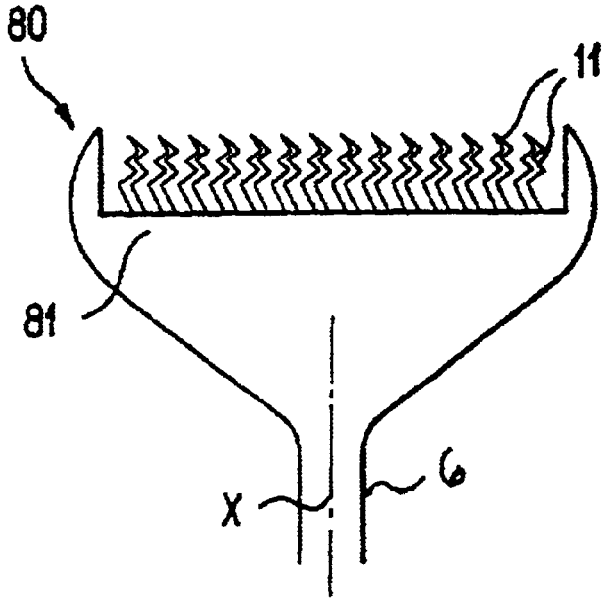
FIG. 17 is a view of an application element positioned transversely on a stem.

In the embodiments shown in FIGS. 1–16, a proximal end of the application element is attached to a distal end portion of the applicator stem, and a distal end of the support provides a free end of the applicator. Alternatively, as shown in FIG. 17, the longitudinal axis of an application element 80 may extend substantially transverse or perpendicularly to a longitudinal axis X of the stem 6. Thus, an end of the stem 6 may be connected to a lateral surface of the application element 80 between opposite ends of the application element. The applicator stem in such an arrangement may be flat. A row of teeth 11 are shown extending from the support 81.

The invention is not restricted to the embodiments which have just been described. For example, the teeth may have shapes other than those shown in the drawings and the teeth need not have the same shape as each other. In particular, it is possible for the teeth to be implemented with other types of relief or with other shapes.

In general, the particular features of each of the embodiments described may be combined, according to the type of product to be applied and the application effect desired. The invention should not be limited to the above-described embodiments.

It will be apparent to those skilled in the art that various modifications and variations can be made to the structure and methodology of the present invention. Thus, it should be understood that the invention is not limited to the embodiments and examples discussed in the specification. Rather, the present invention is intended to cover modifications and variations.

What is claimed is:

1. A system for applying a product to at least one of eyelashes and eyebrows, the system comprising:

an applicator comprising a stem and an application element at an end of the stem, the application element being configured to apply a product to at least one of eyelashes and eyebrows, the application element comprising a support and at least one row of teeth extending from the support, each of the teeth having a free end, a root portion adjacent to the support, and a lateral surface extending from the root portion to the free end, the lateral surface of at least some of the teeth including at least one of a region having a relief and a region having an angular portion;

a receptacle configured to contain the product; and a wiper member, the wiper member being configured to wipe excess product from the application element when the applicator is removed from the receptacle.

2. The system of claim 1, wherein the lateral surface of said at least some of the teeth is not substantially rectilinear when the application element is viewed from a side thereof.

3. The system of claim 1, wherein the lateral surface of said at least some of the teeth includes the region having the angular portion.

4. The system of claim 3, wherein the angular portion is zigzag in shape.

5. A method of applying a product to eyelashes, the method comprising:

providing the system of claim 3;

loading mascara on at least some of the teeth of the application element; and placing at least some of the teeth in contact with eyelashes so that the mascara coats the eyelashes.

6. The system of claim 1, wherein the lateral surface of said at least some of the teeth includes the region having the relief.

7. The system of claim 6, wherein the relief comprises at least one projection.

8. The system of claim 7, wherein the at least one projection extends in a direction away from the support.

9. The system of claim 7, wherein the at least one projection extends in a direction toward the support.

10. The system of claim 7, wherein at least one projection extends in a direction substantially parallel to the support.

11. The system of claim 6, wherein the relief comprises at least one of fluting and an annular groove.

12. The system of claim 6, wherein the relief comprises a serration.

13. A method of applying a product to eyelashes, the method comprising:

providing the system of claim 6, loading mascara on at least some of the teeth of the application element; and placing at least some of the teeth in contact with eyelashes so that the mascara coats the eyelashes.

14. The system of claim 1, wherein the at least one row of teeth comprises teeth having base portions disposed, at least partially, on opposite sides of a geometric separation plane.

15. The system of claim 1, wherein the at least one row of teeth comprises teeth having base portions substantially aligned.

16. The system of claim 1, wherein the application element and the at least one row of teeth are of unitary construction.

17. The system of claim 16, wherein the application element and the at least one row of teeth are constructed by one of molding and stamping.

18. The system of claim 1, wherein the application element includes an elastomer material.

19. The system of claim 1, wherein the application element is an element separate from the stem, the application element being mounted on the stem.

20. The system of claim 1, wherein the application element includes a material more flexible than a material of the stem.

21. The system of claim 1, wherein the at least one row of teeth includes a plurality of rows of teeth, and wherein the application member is configured in the form of a brush.

22. The system of claim 1, wherein the at least one row of teeth comprises teeth having base portions, each base portion having a cross-section having an axis forming an angle with an axis of the support, and wherein the axes of the cross-sections and the axis of the support form a plurality of angles.

23. The system of claim 22, wherein the at least one row of teeth includes a plurality of rows of teeth, and wherein the application member constitutes a brush.

24. The system of claim 1, where the at least one row of teeth comprises teeth having different shapes.

25. The system of claim 1, further comprising a handle member, wherein the stem is on the handle member.

26. The system of claim 25, wherein the receptacle includes an opening configured to permit passage of at least a part of the application element into the receptacle, and wherein the handle member comprises a cap configured to sealably close the opening.

27. The system of claim 1, wherein the support includes an outwardly-convex face, the at least one row of teeth being on the outwardly-convex face.

28. The system of claim 27, wherein an axis of the stem and a line tangent to a point on the outwardly-convex face in a direction at least partially along a longitudinal axis of the outwardly-convex face form an angle, the angle increasing as a distance between the point and the end of the stem increases.

29. The system of claim 1, wherein the at least one row of teeth comprises teeth having a height ranging from about 0.5 mm to about 10 mm.

30. The system of claim 1, wherein the application element further comprises an eye-liner tip.

31. A method of applying a product to at least one of eyelashes and skin adjacent to eyelashes, the method comprising:

providing the system of claim 30; and applying eye liner to skin adjacent to eyelashes with the eye-liner tip.

32. The method of claim 31, further comprising loading mascara on at least some of the teeth; and placing at least some of the teeth in contact with eyelashes so that the mascara coats the eyelashes.

33. The system of claim 1, wherein the lateral surface of said at least some of the teeth is flocked.

34. The system of claim 1, wherein the application element further comprises at least one tuft of bristles located adjacent to a pair of consecutive teeth of the at least one row of teeth.

35. The system of claim 30, wherein the at least one tuft of bristles is located between the pair of consecutive teeth.

36. The system of claim 1, wherein the teeth of the at least one row of teeth are made of an elastic material including a gliding agent for improving gliding of the at least one of eyelashes and eyebrows on the teeth.

37. The system of claim 36, wherein the gliding agent is chosen from polytetrafluoroethylene, graphite, silicones, molybdenum disulfide, and derivatives thereof.

38. The system of claim 1, wherein the receptacle contains the product.

39. The system of claim 38, wherein the product is a cosmetic product configured to be applied to at least one of eyelashes and eyebrows.

40. The system of claim 39, wherein the product is mascara.

41. A method of applying a product to eyelashes, the method comprising:

providing the system of claim 1;

loading a product on at least some of the teeth of the application element; and placing at least some of the teeth in contact with eyelashes so that the product coats the eyelashes.

42. The method of claim 41, wherein the receptacle contains the product, and wherein the loading comprises inserting the applicator into the receptacle containing the product.

43. The method of claim 41, further comprising removing the applicator from the receptacle and wiping excess product from the teeth with the wiper member.

44. The method of claim 41, wherein the receptacle contains the product, and wherein the loading includes dispensing the product from the receptacle onto the teeth.

45. The method of claim 41, wherein the loading includes contacting the teeth with a solid cake of product.

46. The method of claim 45, further comprising moistening the solid cake of product.

47. The method of claim 41, further comprising gripping the eyelashes between consecutive teeth of the at least one row of teeth.

48. The method of claim 41, wherein the loading of the product includes loading mascara on at least some of the teeth.

49. The method of claim 48, wherein the mascara includes fibers, and wherein the method further comprises orienting the fibers with the teeth so that the fibers are substantially parallel to the eyelashes as the product is applied.

50. The method of claim 41, further comprising connecting a portion of the application element of the applicator to the stem of the applicator.

51. The method of claim 50, further comprising selecting an application element from a plurality of application elements and connecting the selected application element to the stem.

52. A system for applying a product to eyelashes, the system comprising:

an applicator comprising a stem and an application element at an end of the stem, the application element being configured to apply a product to at least one of eyelashes and eyebrows, the application element comprising a support and at least one row of teeth extending from the support, each of the teeth having a free end, a root portion adjacent to the support, and a lateral surface extending from the root portion to the free end, the lateral surface of at least some of the teeth including at least one of a region having a relief and a region having an angular portion; and a receptacle containing a cosmetic product configured to be applied to eyelashes, wherein the product is mascara.

53. A method of applying a product to eyelashes, the method comprising:

providing the system of claim 52;

loading mascara on at least some of the teeth; and placing at least some of the teeth in contact with eyelashes so that the mascara coats the eyelashes.

54. A method of applying a product to eyelashes, the method comprising:

providing an applicator comprising a stem and an application element at an end of the stem, the application element being configured to apply a product to eyelashes; the application element comprising a support and at least one row of teeth extending from the support, each of the teeth having a free end, a root portion adjacent to the support, and a lateral surface extending from the root portion to the free end, the lateral surface of at least some of the teeth including at least one of a region having a relief and a region having an angular portion;

loading mascara on at least some of the teeth; and placing at least some of the teeth in contact with eyelashes so that the mascara coats the eyelashes.

55. A system for applying a product to eyelashes, the system comprising:

an applicator comprising a stem and an application element at an end of the stem, the application element being configured to apply a product to eyelashes, the application element comprising a support and at least one row of teeth extending from the support, each of the teeth having a free end, a root portion adjacent to the support, and a lateral surface extending from the root portion to the free end, the lateral surface of at least some of the teeth having at least one irregular-shaped region, the at least one irregular-shaped region being configured to hold the product and to engage the eyelashes, thereby enabling application of the product from the at least one irregular-shaped region to the eyelashes when the application member is moved along the eyelashes; and a receptacle containing a product configured to be applied to eyelashes; and wherein the product is mascara.

56. The system of claim 54, further comprising a wiper member on the receptacle, the wiper member being configured to wipe excess product from the application element when the applicator is removed from the receptacle.

57. The system of claim 54, wherein the irregular-shaped region includes a plurality of troughs, the troughs being configured to hold the product and to engage the eyelashes, thereby enabling smooth application of the product over a surface of the eyelashes when the application element is moved along the eyelashes.

58. The system of claim 57, wherein the irregular-shaped region is zigzag shaped.

59. A method of applying a product to eyelashes, comprising:

providing the system of claim 57;

loading mascara on at least some of the teeth; and placing at least some of the teeth in contact with eyelashes so that the mascara coats the eyelashes.

60. A method of applying a product to eyelashes, the method comprising:

providing the system of claim 58;

loading mascara on at least some of the teeth; and placing at least some of the teeth in contact with eyelashes so that the mascara coats the eyelashes.

61. The method of claim 59, wherein the loading of the mascara comprises loading mascara in at least some of the plurality of troughs.

62. The method of claim 61, wherein the placing includes passing the eyelashes through at least some of the troughs loaded with mascara.

63. The method of claim 59, further comprising gripping the eyelashes with at least some of the plurality of troughs.

64. The system of claim 54, wherein the irregular-shaped region comprises angular portions including a salient angle and a reentrant angle.

65. The system of claim 54, wherein the irregular-shaped region includes a plurality of protrusions configured to engage the eyelashes, thereby enabling smooth application of the product over a surface of the eyelashes when the application element is moved along the eyelashes.

66. The system of claim 65, wherein the protrusions form a plurality of recesses, the recesses being configured to hold the product.

67. The system of claim 65, wherein the protrusions extend in a direction substantially parallel to the support.

68. A method of applying a product to eyelashes, the method comprising:

providing the system of claim 65;

loading mascara on at least some of the teeth; and placing at least some of the teeth in contact with eyelashes so that the mascara coats the eyelashes.

69. The system of claim 66, wherein the protrusions extend in a direction away from the support.

70. The system of claim 66, wherein the protrusions extend in a direction towards the support.

71. A method of applying a product to eyelashes, comprising:

providing the system of claim 66;

loading mascara on at least some of the teeth; and placing at least some of the teeth in contact with eyelashes so that the mascara coats the eyelashes.

72. The method of claim 71, wherein the loading of the mascara comprises loading mascara in at least some of the plurality of recesses.

73. The method of claim 72, wherein the placing includes passing the eyelashes through at least some of the recesses loaded with mascara.

74. The method of claim 71, further comprising gripping the eyelashes with at least some of the plurality of recesses.

75. The system of claim 55, wherein the irregular-shaped region includes a plurality of grooves, the grooves being configured to hold the product and to engage the eyelashes, thereby enabling smooth application of the product over a surface of the eyelashes when the application element is moved along the eyelashes.

76. The system of claim 55, wherein the irregular-shaped region includes serrations, the serrations being configured to hold the product and to engage the eyelashes, thereby enabling smooth application of the product over a surface of the eyelashes when the application element is moved along the eyelashes.

77. The system of claim 55, wherein the at least one row of teeth comprises teeth having base portions disposed, at least partially, on opposite sides of a geometric separation plane.

78. The system of claim 55, wherein the at least one row of teeth comprises teeth having base portions substantially aligned.

79. The system of claim 55, wherein the application element and the at least one row of teeth are of unitary construction.

80. The system of claim 79, wherein the application element and the at least one row of teeth are constructed by one of molding and stamping.

81. The system of claim 55, wherein the application element includes an elastomer material.

82. The system of claim 55, wherein the application element is an element separate from the stem, the application element being mounted on the stem.

83. The system of claim 55, wherein the application element includes a more flexible than a material of the stem.

84. The system of claim 55, wherein the at least one row of teeth comprises teeth having base portions, each base portion having a cross-section having an axis forming an angle with an axis of the support, and wherein the axes of the cross-section and the axis of the support form a plurality of angles.

85. The system of claim 84, wherein the at least one row of teeth includes a plurality of rows of teeth, and wherein the application member constitutes a brush.

86. The system of claim 55, wherein the at least one row of teeth comprises teeth having different shapes.

87. The system of claim 55, further comprising a handle member, wherein the stem is on the handle member.

88. The system of claim 87, wherein the receptacle includes an opening configured to permit passage of at least a part of the application element into the receptacle, and wherein the handle member comprises a cap configured to sealably close the opening.

89. The system of claim 55, wherein the support includes an outwardly-convex face, the at least one row of teeth being on the outwardly-convex face.

90. The system of claim 89, wherein an axis of the stem and a line tangent to a point on the outwardly-convex face in a direction at least partially along a longitudinal axis of the outwardly-convex face form an angle, the angle increasing as a distance between the point and the end of the stem increases.

91. The system of claim 55, wherein the application element further comprises an eye-liner tip.

92. A method of applying a product to at least one of eyelashes and skin adjacent to eyelashes, the method comprising:

providing the system of claim 91; and applying eye liner to skin adjacent to eyelashes with the eye-liner tip.

93. The method of claim 92, further comprising loading mascara on at least some of the teeth; and placing at least some of the teeth in contact with eyelashes so that the mascara coats the eyelashes.

94. The system of claim 55, wherein the lateral surface of said at least some of the teeth is flocked.

95. The system of claim 55, wherein the application element further comprises at least one tuft of bristles located adjacent to a pair of consecutive teeth of the at least one row of teeth.

96. The system of claim 95, wherein the at least one tuft of bristles is located between the pair of consecutive teeth.

97. A method of applying a product to eyelashes, the method comprising:

providing the system of claim 55, loading the product on at least some of the teeth; and placing at least some of the teeth in contact with eyelashes so that the product coats the eyelashes.

98. The method of claim 97, wherein the loading comprises inserting the applicator into the receptacle containing the product.

99. The method of claim 97, wherein the loading includes dispensing the product from the receptacle onto the teeth.

100. The method of claim 97, wherein the loading includes contacting the teeth with a solid cake of product.

101. The method of claim 100, further comprising moistening the solid cake of product.

102. The method of claim 97, further comprising gripping the eyelashes between consecutive teeth of the at least one row of teeth.

103. The method of claim 97, wherein the loading of the product includes loading mascara on at least some of the teeth.

104. The method of claim 103, wherein the mascara includes fibers, and wherein the method further comprises orienting the fibers with the teeth so that the fibers are substantially parallel to the hair as the product is applied.

105. The method of claim 97, further comprising connecting a portion of the application element of the applicator to the stem of the applicator.

106. The method of claim 105, further comprising selecting an application element from a plurality of application elements and connecting the selected application element to the stem.

107. A system for applying a product to eyelashes, the system comprising:

an applicator comprising a stem and an application element at an end of the stem, the application element being configured to apply a product to eyelashes, the application element comprising a support and at least one row of teeth extending from the support, each of the teeth haying a free end, a root portion adjacent to the support, and a lateral surface extending from the root portion to the free end, the lateral surface of at least some of the teeth having at least one irregular-shaped region, the at least one irregular-shaped region being configured to hold the product and to engage the eyelashes, thereby enabling application of the product from the at least one irregular-shaped region to the eyelashes when the application member is moved along the eyelashes; and a receptacle containing a product configured to be applied to eyelashes, wherein the at least one row of teeth includes a plurality of rows of teeth, and wherein the application member is configured in the form of a brush.

108. A system for applying a product to eyelashes, the system comprising:

an applicator comprising a stem and an application element at an end of the stem, the application element being configured to apply a product to eyelashes, the application element comprising a support and at least one row of teeth extending from the support, each of the teeth having a free end, a root portion adjacent to the support, and a lateral surface extending from the root portion to the free end, the lateral surface of at least some of the teeth having at least one irregular-shaped region, the at least one irregular-shaped region being configured to hold the product and to engage the eyelashes, thereby enabling application of the product from the at least one irregular-shaped region to the eyelashes when the application member is moved along the eyelashes; and a receptacle containing a product configured to be applied to eyelashes, wherein the at least one row of teeth comprises teeth having a height ranging from about 0.5 mm to about 10 mm.

109. A system for applying a product to eyelashes, the system comprising:

an applicator comprising a stem and an application element at an end of the stem, the application element being configured to apply a product to eyelashes, the application element comprising a support and at least one row of teeth extending from the support, each of the teeth having a free end, a root portion adjacent to the support, and a lateral surface extending from the root portion to the free end, the lateral surface of at least some of the teeth having at least one irregular-shaped region, the at least one irregular-shaped region being configured to hold the product and to engage the eyelashes, thereby enabling application of the product from the at least one irregular-shaped region to the eyelashes when the application member is moved alone the eyelashes; and a receptacle containing a product configured to be applied to eyelashes, wherein the teeth of the at least one row of teeth are made of a plastic material including a gliding agent for improving gliding of the at least one of eyelashes and eyebrows on the teeth.

110. The system of claim 109, wherein the gliding agent is chosen from polytetrafluoroethylene, graphite, silicones, molybdenum disulfide, and derivatives thereof.

111. A system for applying a product to eyelashes, the system comprising:

an applicator comprising a stem and an application element at an end of the stem, the application element being configured to apply a product to eyelashes, the application element comprising a support and at least one row of teeth extending from the support, each of the teeth having a free end, a root portion adjacent to the support, and a lateral surface extending from the root portion to the free end, the lateral surface of at least some of the teeth having at least one irregular-shaped region, the at least one irregular-shaped region being configured to hold the product and to engage the eyelashes, thereby enabling smooth application of the product to the eyelashes when the application member is moved along the eyelashes;

a receptacle configured to contain a product; and a wiper member, the wiper member being configured to wipe excess product from the application element when the applicator is removed from the receptacle.

112. A method of applying a product to eyelashes, the method comprising:

providing the system of claim 111;

loading mascara on at least some of the teeth; and placing at least some of the teeth in contact with eyelashes so that the mascara coats the eyelashes.

113. The method of claim 112, wherein the receptacle contains the mascara and the loading comprises inserting the applicator into the receptacle containing the product, and wherein the method further comprises removing the applicator from the receptacle and wiping excess mascara from the teeth with the wiper member.

114. A method of applying a product to eyelashes, the method comprising:

providing an applicator comprising a stem and an application element at an end of the stem, the application element being configured to apply a product to eyelashes, the application element comprising a support and at least one row of teeth extending from the support, each of the teeth having a free end, a root portion adjacent to the support, and a lateral surface extending from the root portion to the free end, the lateral surface of at least some of the teeth having at least one irregular-shaped region, the at least one irregular-shaped region being configured to hold the product and to engage the eyelashes, thereby enabling smooth application of the product to the eyelashes when the application member is moved along the eyelashes;

loading mascara on at least some of the teeth; and placing at least some of the teeth in contact with eyelashes so that the mascara coats the eyelashes.

* * * * *

UNITED STATES PATENT AND TRADEMARK OFFICE

CERTIFICATE OF CORRECTION

PATENT NO. : 6,866,046 B2
DATED : March 15, 2005
INVENTOR(S) : Jean-Louis H. Gueret It is certified that error appears in the above-identified patent and that said Letters Patent is hereby corrected as shown below:

Column 15,
Lines 37 and 41, "claim 54" should read -- claim 55 --.

Column 16,
Lines 1 and 4, "claim 54" should read -- claim 55 --.

Signed and Sealed this

Twenty-first Day of June, 2005

JON W. DUDAS
*Director of the United States Patent and Trademark Office*